US006164956A

United States Patent [19]

Payne et al.

[11] Patent Number: 6,164,956

[45] **Date of Patent: *Dec. 26, 2000**

[54] SYSTEM AND METHOD FOR REMOVING ASH DEPOSITS IN A COMBUSTION DEVICE

[75] Inventors: Roy Payne, Mission Viejo; Blair A. Folsom, Santa Ana, both of Calif.; Todd M. Sommer, Dalton, Ohio

[73] Assignee: GE Energy & Environmental Research Corporation, Irvine, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/021,737

[22] Filed: Feb. 11, 1998

Related U.S. Application Data

[60] Provisional application No. 60/037,894, Feb. 11, 1997.

[51] Int. Cl.[7] ..... F23J 11/04

[52] U.S. Cl. ..... 431/3; 15/316.1; 122/390

[58] Field of Search ..... 431/3, 352, 353, 431/32, 122, 9, 354, 351; 165/95; 196/122, 127; 15/316.1, 317; 122/390, 391, 392; 134/8, 177; 208/48 R; 239/104, DIG. 13, 394, 395; 110/182.5, 182.6, 297, 266

[56] References Cited

U.S. PATENT DOCUMENTS

| | | | |
|---|---|---|---|
| 1,129,993 | 3/1915 | Landgrebe | 110/182.5 |
| 1,624,865 | 4/1927 | Freel | 196/122 |
| 2,165,587 | 7/1939 | Sweeny | 196/122 |
| 2,326,525 | 8/1943 | Diwoky | 196/122 |
| 2,342,228 | 2/1944 | Treat | 431/122 |
| 2,535,316 | 12/1950 | Ohlsson | 431/3 |
| 2,885,712 | 5/1959 | Shoulberg | 431/3 |
| 2,982,347 | 5/1961 | Kidwell et al. | 431/9 |
| 3,361,419 | 1/1968 | Siemssen | 110/182.5 |
| 3,589,314 | 6/1971 | Tratz et al. | 110/28 |
| 3,787,168 | 1/1974 | Koppang et al. | 431/354 |
| 4,027,604 | 6/1977 | Jansson | 110/182.5 |
| 4,207,648 | 6/1980 | Sullivan et al. | 15/316.1 |
| 4,248,180 | 2/1981 | Sullivan et al. | 122/390 |
| 4,333,742 | 6/1982 | Tanca | 15/316.1 |
| 4,403,941 | 9/1983 | Okiura et al. | 431/10 |
| 4,444,126 | 4/1984 | Forster | 110/238 |
| 4,492,187 | 1/1985 | Hammond | 122/390 |
| 4,525,176 | 6/1985 | Koog et al. | 48/197 R |
| 4,575,332 | 3/1986 | Oppenberg et al. | 431/351 |
| 4,583,496 | 4/1986 | Albers et al. | 122/390 |
| 5,337,441 | 8/1994 | Miyamoto et al. | 122/390 |
| 5,443,805 | 8/1995 | Beer et al. | 423/235 |
| 5,513,583 | 5/1996 | Battista | 110/261 |

FOREIGN PATENT DOCUMENTS

| | | | |
|---|---|---|---|
| 38510 | 3/1984 | Japan | 431/3 |
| 8509 | 1/1986 | Japan | 431/3 |

OTHER PUBLICATIONS

Eckhart C.F., and DeVault R.F., *Cyclone Reburn Using Coal–Water Fuel,* Report DOE/PC/90157–1, Oct. 1991.

Gullett B.K., et al., *Furnace Slurry Injection for Simultaneous SO2/NOx Removal*, The 1991 SO2 Control Symposium, vol. 2: Sessions 5A–6B, Dec. 3–6, 1991.

*Primary Examiner*—Carl D. Price
*Assistant Examiner*—David Lee
*Attorney, Agent, or Firm*—Workman, Nydegger & Seeley

[57] ABSTRACT

A self cleaning port system and method provides for removal of ash deposits and build-up from around a port opening in a combustion device such as an industrial or utility furnace or boiler. The self cleaning port system includes a port structure for providing communication between a source of injected material and an interior portion of the combustion device. The port structure can be a burner for injecting fuel and air, an overfire air port, a flue gas recirculation port, a reburning port for injecting a reburning fuel, a pollutant emission control port for injecting $NO_x$ or $SO_2$ reduction agents, or other types of ports. A blowing member such as a lance is disposed within or formed as part of the port structure and is configured to discharge a blowing medium so as to remove ash deposits adjacent to the port opening. The blowing medium is discharged from the blowing member such that the blowing medium is directed outwardly away from the port opening.

16 Claims, 6 Drawing Sheets

SYSTEM AND METHOD FOR REMOVING ASH DEPOSITS IN A COMBUSTION DEVICE

This patent application claims priority to provisional patent application Ser. No. 60/037,894, filed on Feb. 11, 1997, the disclosure of which is herein incorporated by reference.

BACKGROUND OF THE INVENTION

1. The Field of the Invention

The present invention relates to self cleaning systems and methods for use in combustion devices. More particularly, the present invention relates to a self cleaning port system and method for reducing and removing ash deposits around a port in a combustion device such as in industrial and utility boilers or furnaces.

2. The Relevant Technology

In industrial and utility boiler or furnace combustion systems fired with fuels which contain ash such as coal, oil, biomass, and the like, ash deposits can form on the furnace walls. Depending on the characteristics of the ash and the thermal conditions in the furnace, the deposits can be solid or molten. Ash deposits can cause various problems in the operation of a combustion system, such as reducing heat transfer.

The conventional approach to control of furnace wall ash deposits involves the use of wall blowers which are short lances inserted through holes in the furnace wall. A material such as steam or air, which is termed the "blowing medium," is injected into the lance from outside the boiler or furnace and exits the lance through one or more holes in the lance which are directed parallel to or at an angle to the furnace wall. The blowing medium is injected at high velocity such that ash deposits on the furnace wall in the vicinity of the wall blower are dislodged from the surface of the furnace wall.

A number of wall blower designs have been developed in the past. The most common designs utilize a retractable lance which is normally recessed into the furnace wall. During a cleaning cycle, the lance is inserted into the furnace, the flow of the blowing medium is started and the lance is rotated so as to sweep a circular area of the furnace wall in the vicinity of the lance free from ash. At the end of the cleaning cycle, the lance is retracted back into the furnace wall.

Various types of equipment used in combustion systems require the injection of certain materials such as fuel, air, flue gas, nitrogen oxide ($NO_x$) reduction agents, and sulfur dioxide ($SO_2$) reduction agents into the furnace for the purpose of effecting combustion, pollutant emission control, and other functions. These materials are injected into the furnace through holes or ports in the furnace walls that can be configured in different ways. Examples of ports include burners where fuel and air are injected, overfire air ports where air is injected, flue gas recirculation ports where flue gas is injected, reburning ports where a reburn fuel is injected, pollutant emission control ports, and the like. In the discussion hereafter, the structure defining a hole or holes through the wall of a furnace where a material is injected is termed a "port" or "ports" and the material injected through the port is termed the "injected material." Such ports can include a single passageway or multiple passageways through a single hole in the furnace wall.

There are two basic types of furnaces used in combustion systems, including those with refractory covered walls and those with tubewalls. Most boilers have tubewalls where the furnace walls are formed of a series of vertical tubes side-by-side. The tubes can be directly welded together (tangent tubes), or there can be a short flat section welded between the tubes (membrane wall). The tubes can also be separate and stand in front of a refractory wall. In most applications the tubes are vertical, but in some applications the tubes run horizontally or at angles. In such tubewall furnaces, ports are formed by bending one or more tubes out of the plane of the tube wall and bending the adjacent tubes to form the port opening. The passageways for the injected material (e.g., fuel, air, $NO_x$ reduction agents, etc.) and burner components where applicable are inserted within the port opening.

In the normal operation of the ports in a combustion system, the flow of the injected material entrains furnace gases and suspended ash particles, thereby drawing such gases and particles to the entrance of the port where they can form ash deposits therearound on the furnace wall. These ash deposits are often detrimental to the operation of the port. A port with high velocity injection may exacerbate these local ash deposition problems. The size, shape and consistency of these deposits are often not symmetric and may be solid or molten. In some cases these deposits form "eyebrows" which may extend a considerable distance into the furnace, thereby affecting the operation of the port and changing furnace flow patterns. If these large deposits break off, they can fall to the furnace floor and cause structural damage. In other cases, molten ash deposits can drip over the port opening, partially or fully blocking the opening.

Conventional wall blowers are ineffective in removing the deposits around ports for several reasons. Such blowers are often located a considerable distance away from the ports due to mechanical interferences, reducing blower effectiveness. If the blowers are located close to the ports, the flow produced by the blowing medium can disrupt the normal operation of the port. The flow produced by conventional blowers tends to push deposits over the port opening, which can cause blockage, particularly with molten or partially molten deposits.

Thus, there is a need for a device which can be adapted to ports in a combustion system to provide for effective cleaning and ash deposit removal while minimizing any impact on the normal operation of the ports or other adverse effects.

SUMMARY AND OBJECTS OF THE INVENTION

The present invention is a system and method for reducing and removing ash deposits or build-up from around a port opening in a combustion device, such as in industrial and utility boilers or furnaces. A self cleaning port system according to the invention comprises a port means for providing communication between a source of one or more injected materials and the interior of a combustion furnace. Such a port means preferably includes a port structure such as a pipe or pipes with a single passageway or multiple passageways that communicate with the interior of a combustion furnace through a hole in the furnace wall. The system further comprises a blowing means for discharging a blowing medium to remove ash deposits on the furnace wall, such as a wall blower or blowing lance, which is rigidly or movably disposed within the port structure or is formed as part of the port structure. The blowing lance is preferably configured so that the blowing medium is directed through one or more lance holes located within the port and blowing generally outward away from the port opening.

The invention is a self-cleaning port which avoids the ash deposition problems of conventional ports. The invention integrates a wall blower into a port itself as distinct from the conventional approach of installing a wall blower adjacent to a port. The blowing medium is directed outward from the port in order to blow the ash deposits away from rather than across the port as in prior approaches. The distance between the wall blower and the port edge in the device of the invention is minimized, thereby providing effective ash deposit removal. The present invention can be applied to virtually any type of port in any combustion system, including simple circular ports and complex ports such as burners. The ports of the present invention can thus include burners where fuel and air are injected, overfire air ports where air is injected, flue gas recirculation ports where flue gas is injected, reburning ports where a reburn fuel is injected such as pulverized coal and air, pollutant emission control ports for injecting agents for $NO_x$ reduction and $SO_2$ reduction, sorbent injection ports, and the like.

In a first embodiment of the invention, a wall blowing lance is located on the port centerline, with the lance extending into the interior of the furnace. The blowing medium such as air or steam is discharged through one or more holes in the lance and the blowing medium is directed along the inner surface of the furnace wall at a slight angle. To cover the full area around the port opening, the lance may be rotated while the blowing medium is being discharged. Depending on the application, it may be desirable to alter the configuration of the first embodiment by altering the axial position of the lance, changing the angle of blowing medium injection, using different numbers of holes in the lance, or using multiple lances. The lance may be fixed, or configured to move axially forward or retracted if desired in order to optimize the furnace wall cleaning, to protect the lance from thermal radiation from the furnace, or to eliminate any flow restriction for the injected material. The lance can also be inserted off of, but parallel to, the centerline or at an angle to the centerline. Also, if the port contains several passages, as with a burner, the lance could be inserted through any of the passages in the port.

In a second embodiment of the self-cleaning port of the invention, an annular blowing lance surrounds an inner port pipe disposed within the port structure such that the injected material passes through the center of the lance and the blowing medium passes through a surrounding annulus. This configuration avoids the interaction of the blowing medium with the flowing stream of injected material.

In a third embodiment of the invention, the self-cleaning port also provides cooling for the port during the non-cleaning cycle of the combustion operation. An annular blowing member is configured around an inner port pipe and has an annular passageway for transporting a blowing/cooling medium. The inner wall of the annular passageway which is the outer wall of the port pipe includes a sleeve with an attached lip portion which slides in an axial direction of the port pipe. The third embodiment is preferred for applications where the flow of the injected material through the port is insufficient to prevent overheating of the port due to thermal radiation from the furnace.

In other embodiments of the invention, a single port in a furnace is provided with multiple passageways, such as in a burner port or a multiple injection port. A blowing medium is injected in any one or more of the passageways by one or more blowing members. The burner port or multiple injection port can be formed in a tubewall furnace or a refractory lined furnace.

In a method for removing ash deposits in a combustion device according to the present invention, a self-cleaning port system as described above is provided in the combustion device. An injection material or medium such as fuel and air, overfire air, flue gas, reburning fuel, $NO_x$ and $SO_2$ reduction agents, and the like, is injected through the port opening by an appropriate injection member into the interior of the combustion device. A blowing medium such as steam or air is discharged from a blowing member outwardly away from the port opening at a sufficient rate to substantially remove ash deposits from the furnace wall area surrounding the opening to the port.

Accordingly, a principle object of the present invention is to provide a system and method for reducing and removing ash deposits from around a port opening in a combustion device.

Another object of the invention is to provide a system and method for providing effective ash deposit removal while minimizing any impact on the normal operation of a port in a combustion device.

These and other objects and features of the present invention will become more fully apparent from the following description, or may be learned by the practice of the invention as set forth hereinafter.

BRIEF DESCRIPTION OF THE DRAWINGS

In order to more fully understand the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The present invention is directed to a system and method for reducing and removing ash deposits or build-up from around a port opening in a combustion device, such as in industrial and utility boilers or furnaces. A self cleaning port system according to the invention generally includes a port structure such as a pipe or pipes with a single passageway or multiple passageways that communicate with the interior of a combustion furnace through a hole in the furnace wall to provide one or more injected materials into the furnace. The system further includes a blowing member such as a wall blower or blowing lance for discharging a blowing medium to remove ash deposits on the furnace wall surrounding the port opening. The blowing member is rigidly or movably disposed within the port structure or is formed as part of the port structure. The blowing member is preferably configured so that the blowing medium is directed through one or more blowing member holes located within the port structure and blowing outwardly away from the port opening.

The present invention can be applied to virtually any type of port in any combustion system, including simple circular ports and complex ports such as burners which may be circular or of other shapes. The ports that can be used with the present invention can thus include burners where fuel and air are injected, overfire air ports where air is injected, flue gas recirculation ports where flue gas is injected, and reburning ports where a reburning fuel is injected such as pulverized coal and air. Other ports that can be used with the present invention include pollutant emission control ports for injecting agents for $NO_x$ reduction and $SO_2$ reduction. Suitable agents that can be injected for $NO_x$ reduction include urea, ammonia, cyanuric acid, hydrogen peroxide, methanol, mixtures thereof, and the like. Suitable agents for $SO_2$ reduction include limestone, lime, hydrated lime, mixtures thereof, and the like, in either solid, liquid, or slurry forms. In addition, sorbent injection ports for injecting a variety of sorbent materials may also be employed in the present invention. Various mixtures or combinations of the above injection materials can also be utilized as desired for a particular application.

Figure 1B:
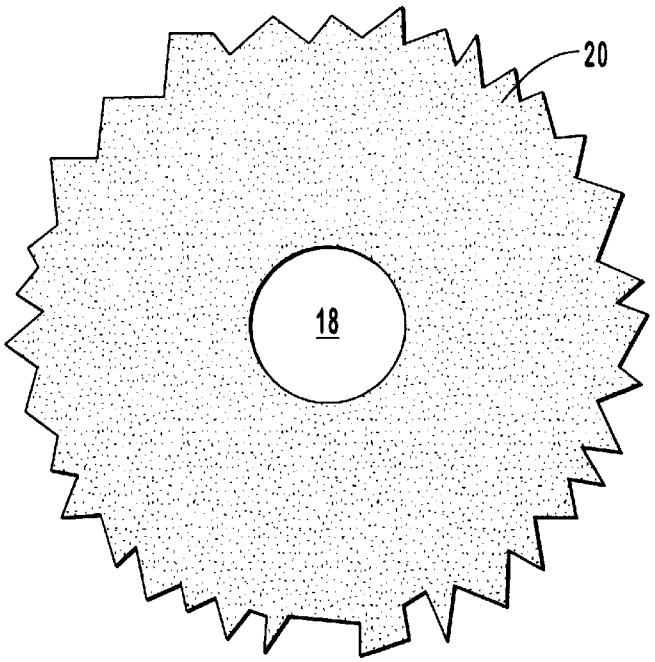
FIGS. 1A and 1B are schematic depictions of a side sectional view and a front view of a port in a furnace wall with ash deposits surrounding the opening to the port.
Figure 1A:
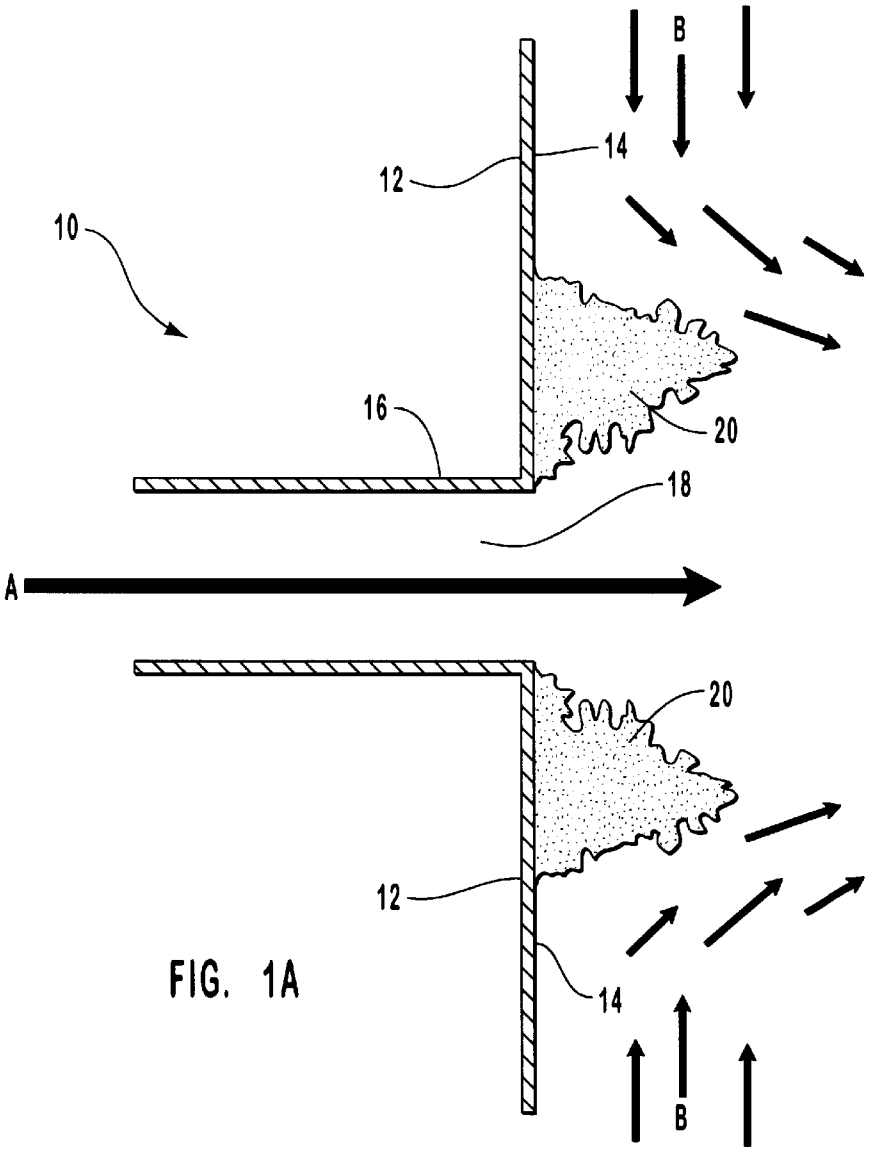

Referring to the drawings, wherein like structures are provided with like reference designations, FIGS. 1A and 1B illustrate a typical eyebrow ash deposit around a conventional port configuration in a furnace 10. The furnace 10 has a furnace wall 12 with an interior surface 14 which divides the inside of furnace 10 from the outside of furnace 10. A port structure 16, which is shown as a round pipe but may be a passage of any shape, is disposed outside of furnace wall 12 and penetrates furnace wall 12 to communicate with the interior of furnace 10. An injected material indicated by arrow A passes through a port opening 18 of port structure 16 and into the inside of furnace 10. The flow of the injected material entrains furnace gases and suspended ash indicated by arrows B, thereby producing an ash deposit 20 on interior surface 14 surrounding opening 18 of port structure 16.

Figure 2B:
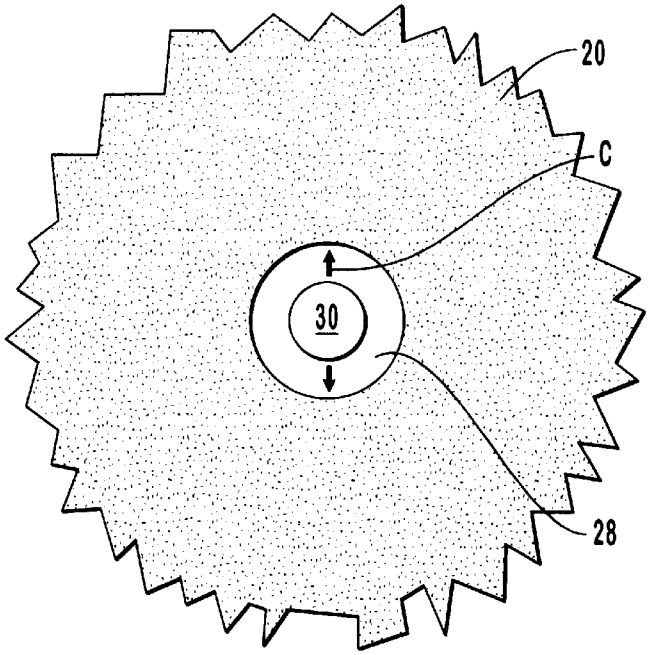
FIGS. 2A and 2B are schematic depictions of a side sectional view and a front view of a self-cleaning port with a central blowing lance according to one embodiment of the invention.
Figure 2A:
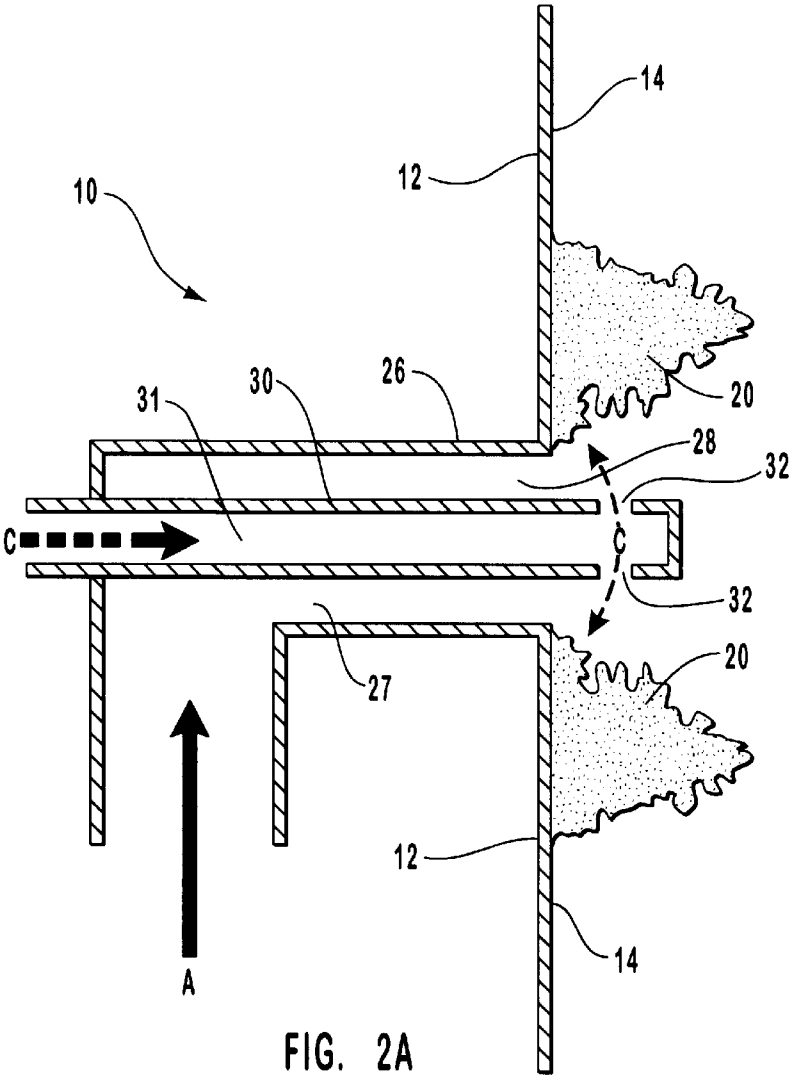

FIGS. 2A and 2B are schematic depictions of a self-cleaning port with a central blowing lance according to a first embodiment of the invention. It should be understood that the blowing lance can also be positioned anywhere in the port off of the port centerline. The lance is located within the port such that the injected material flows around the lance. This embodiment is preferred for applications where the flow of the blowing medium does not adversely impact the operation of the port or where the size of the port is large.

As shown in FIG. 2A, furnace wall 12 has a port means for providing communication between a source of injected material and an interior portion of furnace 10 in the form of a port structure 26 such as a pipe. The port structure 26 penetrates through furnace wall 12 to communicate with the interior of furnace 10. An injected material indicated by arrow A passes through a port passageway 27 and a port opening 28 into the inside of furnace 10. The injected material interacts with the furnace gases and suspended ash to produce an ash deposit 20 on interior surface 14 surrounding port opening 28 of port structure 26 as shown in FIGS. 2A and 2B. Although the port structure 26 is generally circular in cross-section, the port structure can be configured into a variety of shapes, such as square, rectangular, triangular, etc.

A blowing means for discharging a blowing medium is provided in the form of blowing member such as a retractable blowing lance 30, which is located within passageway 27 of port structure 26. The blowing lance 30 is configured to be moved longitudinally back and forth along the direction of the port axis perpendicular to furnace wall 12. Under normal operation after a cleaning cycle, blowing lance 30 is retracted out of port passageway 27 so as to not interfere with the flow of the injected material. When ash deposit removal is desired, blowing lance 30 is extended a preselected distance beyond port opening 28 into the interior of furnace 10, such as shown in FIG. 2A, during a cleaning cycle.

The position of blowing lance 30 can be varied to adjust the flow angle as desired. A blowing medium indicated by arrows C is introduced into a proximal end of lance 30, and flows through a passageway 31 out into the interior of furnace 10 through one or more lance holes 32 at a distal end of lance 30. The force produced by the impact of the blowing medium on ash deposit 20 dislodges ash deposit 20 from interior surface 14 and blows deposit 20 away from port opening 28. To effect complete cleaning around the circumference of port opening 28, lance 30 may have an additional number of lance holes formed therein. Also, lance 30 may be axially rotated during the cleaning operation so that the blowing medium is directed radially outward toward ash deposit 20. At the end of the cleaning cycle, the flow of the blowing medium is stopped and lance 30 is retracted back out of the path of the injected material.

The design of the first embodiment of the self-cleaning port of the invention for a specific application can be adjusted to produce the best overall balance of performance including cost by considering the effectiveness of ash deposit removal, impact on port operation, amount of blowing medium required, and cost of the self-cleaning port itself. This requires adjustment of the following design parameters.

During the cleaning cycle, the lance holes may be positioned so as to blow outward at an angle to the interior surface of the furnace wall, or parallel to the interior surface of the furnace wall. Also during the cleaning cycle, the lance holes may be positioned either inside the furnace (as illustrated in FIG. 2A), flush with the furnace wall, or outside the furnace wall. In addition, the number, size and shape of the lance holes may be varied, as needed for a specific application. In time periods other than the cleaning cycle, the blowing lance may be fully retracted, as discussed above, partially retracted, or not retracted. The blowing lance can also be positioned on a centerline of the port passageway as illustrated in FIG. 2A, or off the centerline or at an angle to the centerline. If the port has multiple passageways, the lance may be positioned in any of the passageways and more than one lance may be used.

Figure 3B:
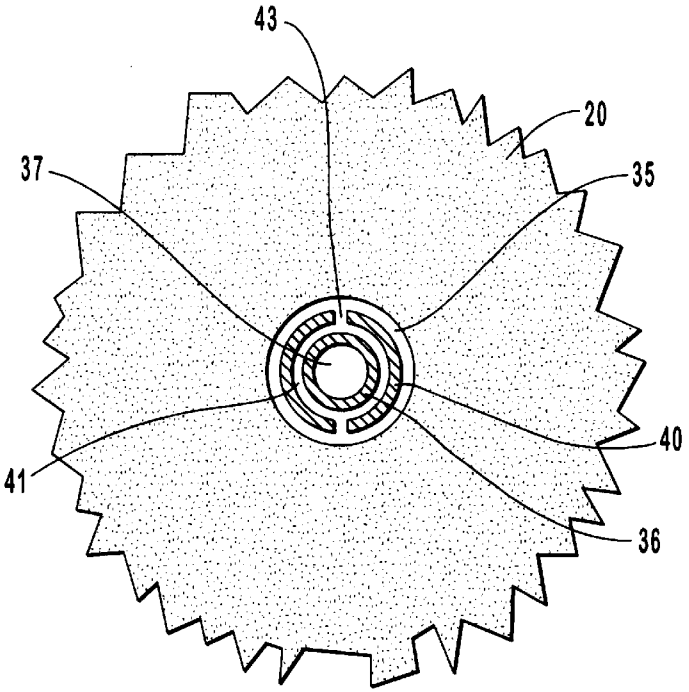
FIGS. 3A and 3B are schematic depictions of a side sectional view and a front sectional view of a self-cleaning port with an annular blowing lance according to another embodiment of the invention.
Figure 3A:
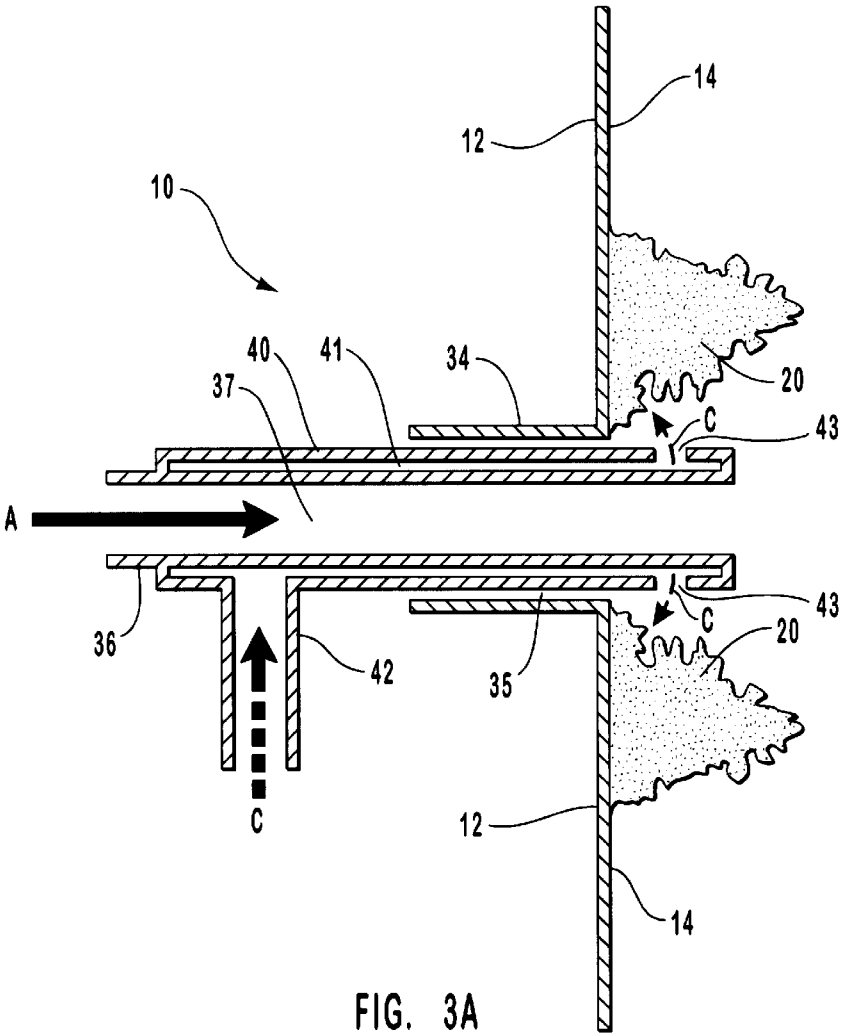

FIGS. 3A and 3B are schematic depictions of a self cleaning port with an annular blowing lance according to a second embodiment of the invention. The annular lance is located within the self-cleaning port such that the injected material flows through the lance. The second embodiment is preferred for applications where the flow of the blowing medium adversely impacts the operation of the port or where the diameter of the port is small such that the annular lance is of a practicable size.

As shown in FIG. 3A, furnace wall 12 divides the inside of furnace 10 from the outside of furnace 10. An outer port sleeve 34 defines a furnace opening 35 in furnace wall 12 and is communicatively connected to furnace 10. The port sleeve 34 is used to guide the motion of an inner port pipe 36 and an annular blowing member such as a blowing lance 40 configured around port pipe 36. The inner port pipe 36 has an interior passageway 37 for transporting an injected material indicated by arrow A into an interior portion of furnace 10. The lance 40 has an annular passageway 41 which is defined by the outer wall surface of port pipe 36 and the inner wall surface of lance 40. A blowing medium indicated by arrows C is introduced into an inlet tube 42 and passes through annular passageway 41 of lance 40 out through a pair of lance holes 43 to impact and remove an ash deposit 20 on interior surface 14 around opening 35 of furnace 10.

Under normal operation when cleaning is not required, annular lance 40 is retracted (not shown) to be flush with furnace wall 12. When ash deposit removal is desired, lance 40 is moved a preselected distance into furnace 10, such as shown in FIG. 3A, during a cleaning cycle. The blowing medium is introduced into the lance 40 and flows out into furnace 10 through lance holes 43. The force produced by the impact of the blowing medium on ash deposit 20 dislodges deposit 20. To effect complete cleaning around the circumference of opening 35, a number of additional lance holes may be formed in lance 40. Also, lance 40 may be rotated during the cleaning cycle. At the end of the cleaning cycle, the flow of the blowing medium is stopped and lance 40 is retracted back flush with furnace wall 12.

The design of the self-cleaning port of the second embodiment of the invention for a specific application can be adjusted to produce the best overall balance of performance including cost by considering the effectiveness of ash deposit removal, impact on port operation, amount of blowing medium required, and cost of the self-cleaning port itself. This requires adjustment of the following design parameters.

During the cleaning cycle, the lance holes may be positioned so as to blow outward at an angle to the furnace wall or parallel to the furnace wall. Also during the cleaning cycle, the lance holes may be positioned either inside the furnace (as illustrated in FIG. 3A), flush with the furnace wall, or outside the furnace wall. In addition, the number, size and shape of the lance holes may be varied as needed for a specific application. Further, the port sleeve may serve as the outer wall of the lance. In time periods other than the cleaning cycle, the annular lance may be retracted flush with the furnace wall, as discussed above, partially retracted, or not retracted. If the port has multiple passageways, the annular lance may be positioned around a central passageway, or around both a central passageway and one or more annular passageways, and one or more annular lances may be used.

Figure 4B:
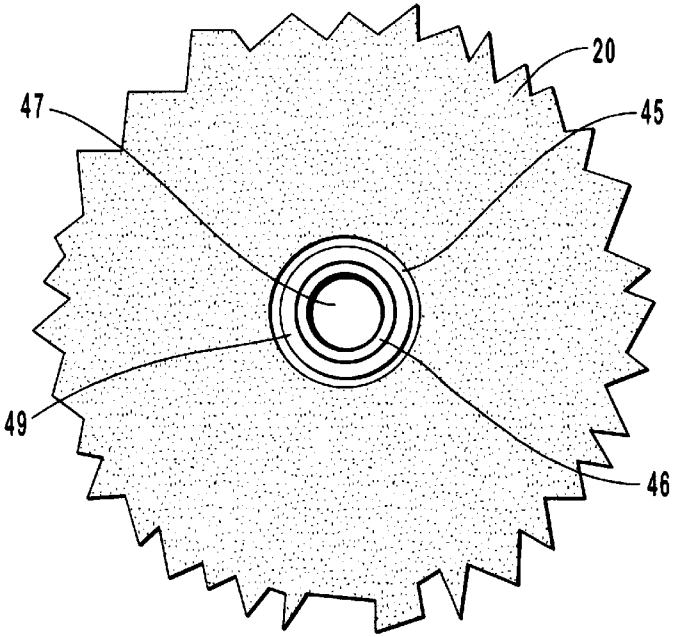
FIGS. 4A and 4B are schematic depictions of a side sectional view and a front view of a self-cleaning port with an annular cleaning/cooling configuration according to a further embodiment of the invention.
Figure 4A:
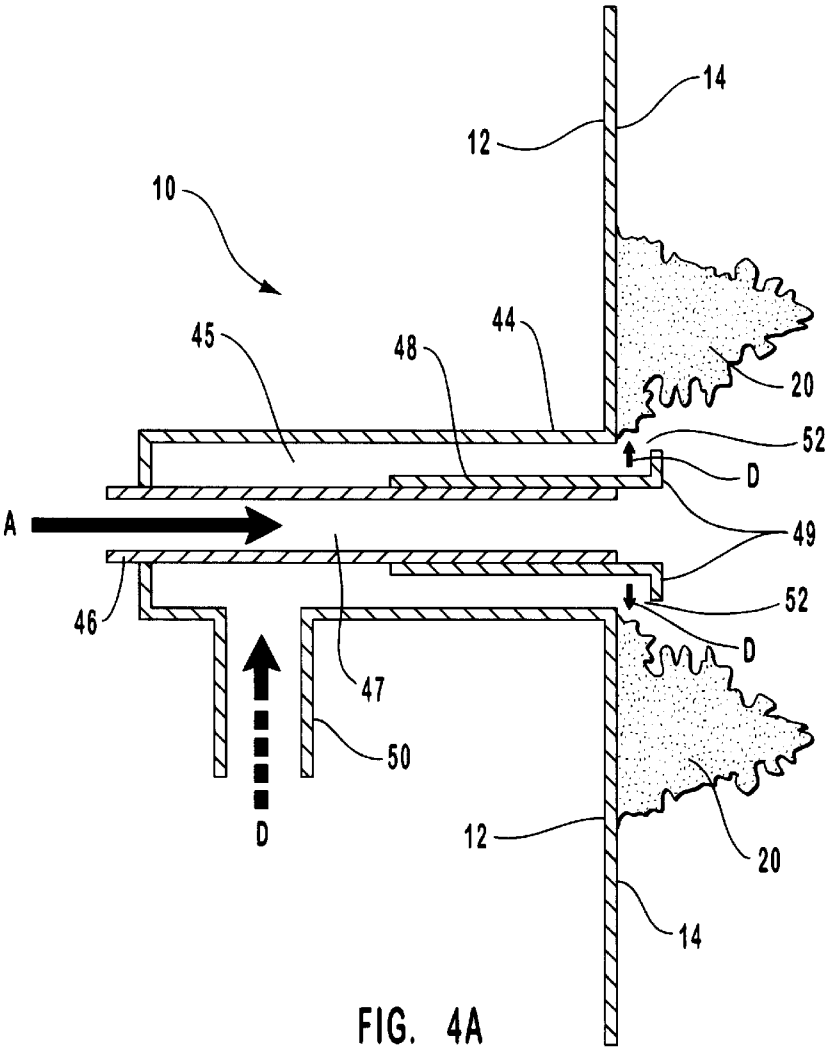

FIGS. 4A and 4B are schematic depictions of a self-cleaning port with an annular cleaning/cooling configuration according to a third embodiment of the invention. The self-cleaning port of the third embodiment is a cleaning system which also provides cooling for the port during the non-cleaning portion of the combustion operation. As discussed in further detail below, the inner wall of the blowing medium passageway includes a sleeve which slides in an axial direction. The third embodiment is preferred for applications where the flow of the injected material through the port is insufficient to prevent overheating of the port due to thermal radiation from the furnace.

As shown in FIG. 4A, furnace wall 12 divides the inside of furnace 10 from the outside of furnace 10. An outer sleeve communicatively connected through furnace wall 12 with the interior of furnace 10 forms the outer boundary of an annular blowing member 44 having an annular passageway 45 through which a blowing/cooling medium indicated by arrows D flows. The inner boundary of annular passageway 45 is defined by an inner port pipe 46. An injected material indicated by arrow A flows through a central passageway 47 of port pipe 46, and exits into furnace 10. An inner sliding sleeve 48 has an attached lip portion 49 formed at a distal end thereof. The sliding sleeve 48 is slidably engaged with port pipe 46 and is positioned in annular passageway 45 between blowing member 44 and port pipe 46. The sliding sleeve 48 is designed to move freely in an axial direction. The sliding sleeve 48 and lip portion 49 can slide in an axial direction so that lip portion 49 is inserted into furnace 10 (as shown in FIG. 4A), or can be retracted into blowing member 44. In the retracted position, the blowing/cooling medium leaks through the clearances between furnace wall 12 and lip portion 49 and between port pipe 46 and lip portion 49, providing cooling for port pipe 46 and also helping to prevent ash deposition on interior surface 14 of furnace wall 12 near lip portion 49 and port pipe 46.

At the start of a cleaning cycle, the blowing/cooling medium is introduced into annular passageway 45 from an inlet tube 50 and the flow rate is increased, blowing any ash deposits out of the space between blowing member 44 and port pipe 26. Then sliding sleeve 48 and attached lip portion 49 are moved axially so that lip portion 49 protrudes into the interior of furnace 10 a preselected distance, as shown in FIG. 4A. In this extended position, the blowing/cooling medium flows through an open area 52 formed by the clearance between furnace wall 12 and lip portion 49 so as to impact ash deposit 20 to effect ash removal. The blowing member 44 works in conjunction with lip portion 49 such that the blowing/cooling medium is directed outwardly toward ash deposit 20.

The design of the self-cleaning port of the third embodiment of the invention for a specific application can be adjusted to produce the best overall balance of performance including cost by considering the effectiveness of ash deposit removal, impact on port operation, amount of blowing medium required, and cost of the self-cleaning port itself. This requires adjustment of the following design parameters.

The design of the lip portion on the sliding sleeve may be altered to change the way in which the blowing/cooling medium passes into the furnace. For example, the lip portion may be serrated to allow increased flow of the blowing/cooling medium in the retracted position. The lip may portion may also be curved to enhance the flow of the blowing/cooling medium in the inserted position. The lip portion may be designed to reduce the open area into the furnace so that the blowing medium exits into the furnace through one or more discrete holes rather than the circular/annular opening illustrated in FIGS. 4A and 4B.

Various means for moving the sliding sleeve and the attached lip may also be employed. The sliding sleeve and lip may be moved by a mechanical linkage driven manually by hand or automatically by mechanical, pneumatic, hydraulic, or electrical devices. The sliding sleeve and lip may also be moved by the pressure of the blowing medium acting on the surface of the sliding sleeve and lip, or other surfaces which may be added. Movement of the sliding sleeve and lip may also be controlled by springs.

FIGS. 5A, 5B and 6A, 6B depict embodiments of the invention where a single port in a furnace is provided with multiple passageways. A blowing medium is injected in any one or more of the passageways by one or more blowing members.

Figure 5B:
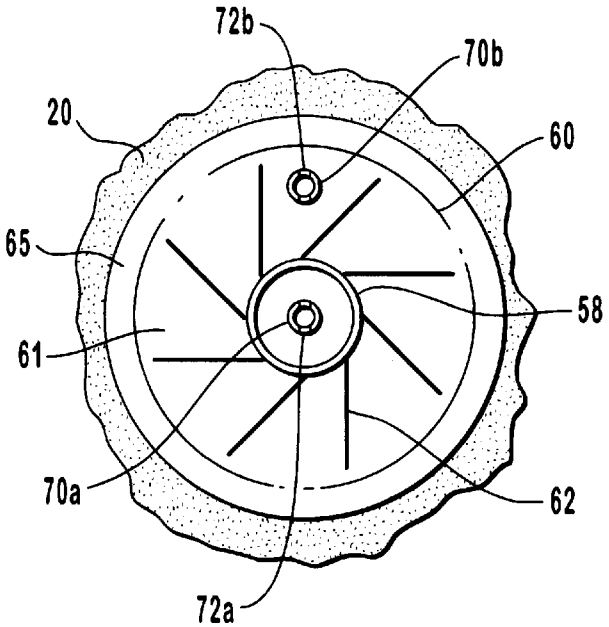
FIGS. 5A and 5B are schematic depictions of a side sectional view and a front view of a self-cleaning burner port according to another embodiment of the invention.
Figure 5A:
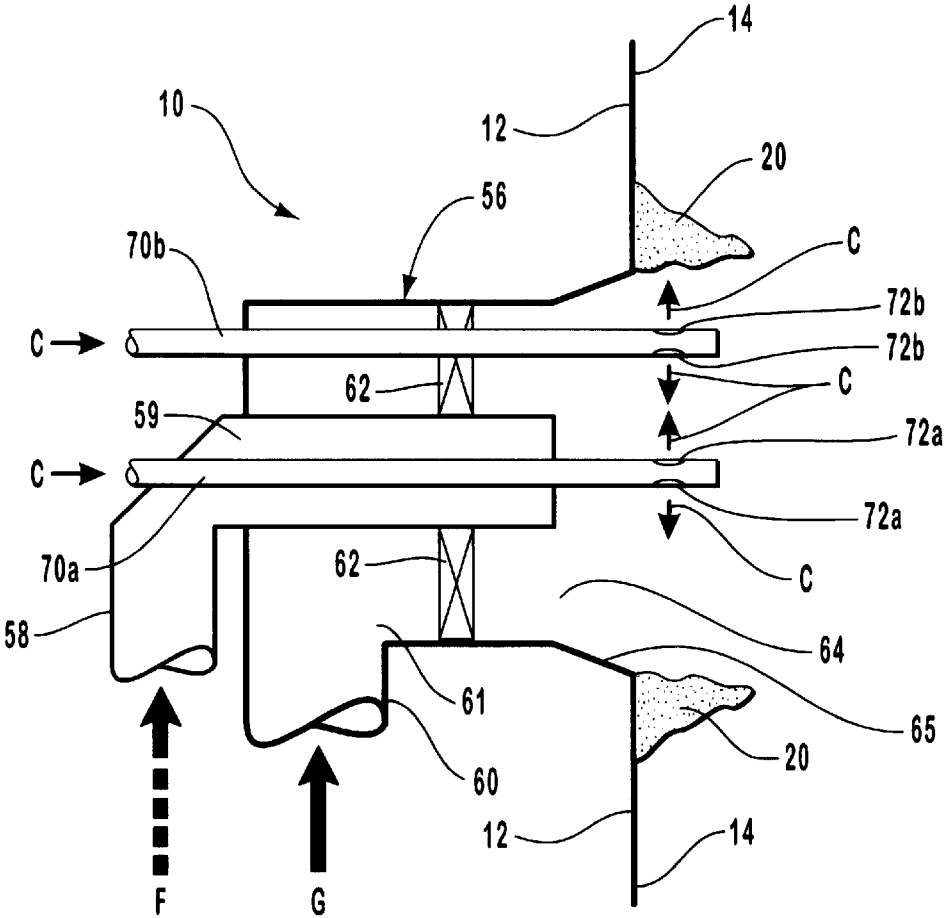

FIGS. 5A and 5B are schematic depictions of a self-cleaning burner port according to another embodiment of the invention. As discussed in further detail below, one or more ash removing devices such as blowing members or lances are located within the passageways of the burner port for injecting a blowing medium. The burner port can be formed in a tubewall furnace or a refractory lined furnace.

As shown in FIG. 5A, furnace wall 12 has a burner port 56 which communicates with the interior of furnace 10. The burner port 56 has a fuel injecting pipe 58 with a fuel passageway 59, and an air injecting pipe 60 with an air passageway 61. The coaxial configuration of fuel pipe 58 and air pipe 60 shown in FIGS. 5A and 5B are only illustrative of one type of burner that can be used in the present invention. A wide range of burners can be utilized which have one or more fuel passageways and one or more air passageways. The burner port 56 can optionally have a swirling means for making the air flow swirl such as swirl vanes 62 disposed in air passageway 61. The fuel pipe 58 can be a simple pipe structure or can have a wide range of other optional design features such as swirlers, lips, dividers to make multiple passageways, etc.

The burner port 56 has a port opening 64 defined by an outwardly flared surface 65 so that opening 64 diverges into the interior of furnace 10 as shown in FIG. 5A. Alternatively, the port opening may be defined by an inwardly flared surface so that the port opening converges into the interior of the furnace, or the port opening may be defined by a straight cylindrical surface.

An injected fuel material indicated by arrow F passes through fuel passageway 59 and port opening 64 into the inside of furnace 10. Injected air indicated by arrow G passes through air passageway 61 and port opening 64 into the inside of furnace 10. The injected fuel and air interact with furnace gases and suspended ash to produce an ash deposit 20 on interior surface 14 surrounding port opening 64 as shown in FIGS. 5A and 5B.

A pair of blowing lances 70*a* and 70*b* for discharging a blowing medium are located within fuel passageway 59 and air passageway 61, respectively, of burner port 56. The blowing lances 70*a* and 70*b* are configured to be moved longitudinally back and forth along the direction of the port axis perpendicular to furnace wall 12. Under normal operation after a cleaning cycle, blowing lances 70*a* and 70*b* are retracted out of passageways 59 and 61 so as to not interfere with the flow of fuel and air. When ash deposit removal is desired, blowing lances 70*a* and 70*b* are extended a preselected distance beyond port opening 64 into the interior of furnace 10, such as shown in FIG. 5A, and the blowing medium is directed outwardly through one or more lance holes 72*a* and 72*b* at the distal tips of blowing lances 70*a* and 70*b*.

It should be understood that FIGS. 5A and SB show two potential locations for the the blowing lances, and that the blowing lances can be located anywhere in the burner port with a passageway. Further, the blowing lances can be positioned parallel or at an angle to the axis within the burner port. In addition one lance can be used or more than two lances may be used if desired for a specific application.

During a cleaning cycle, a blowing medium indicated by arrows C is introduced into a proximal end of lances 70*a* and 70*b*, and the blowing medium is injected out into the interior of furnace 10 through lance holes 72*a* and 72*b*. The force produced by the impact of the blowing medium on ash deposit 20 dislodges ash deposit 20 from interior surface 14 and blows deposit 20 away from port opening 64. The lances 70*a* and 70*b* may be axially rotated during the cleaning operation to effect complete cleaning around the circumference of port opening 64. At the end of the cleaning cycle, the flow of the blowing medium is stopped and lances 70*a* and 70*b* are retracted back out of the paths of the fuel and air.

Figure 6B:
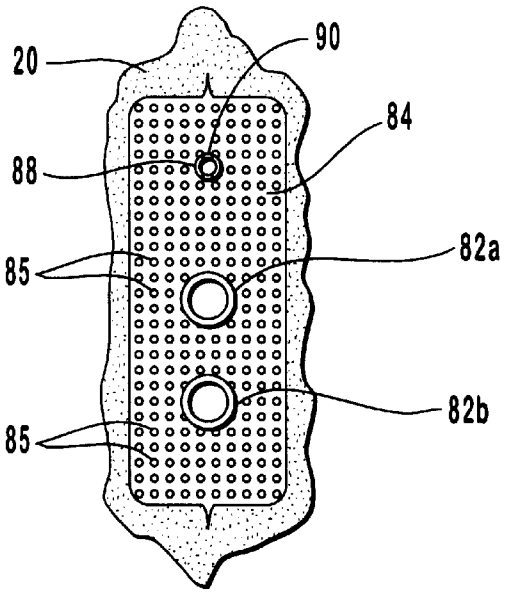
FIGS. 6A and 6B are schematic depictions of a side sectional view and a front view of a self-cleaning multiple injection port according to a further embodiment of the invention.
Figure 6A:
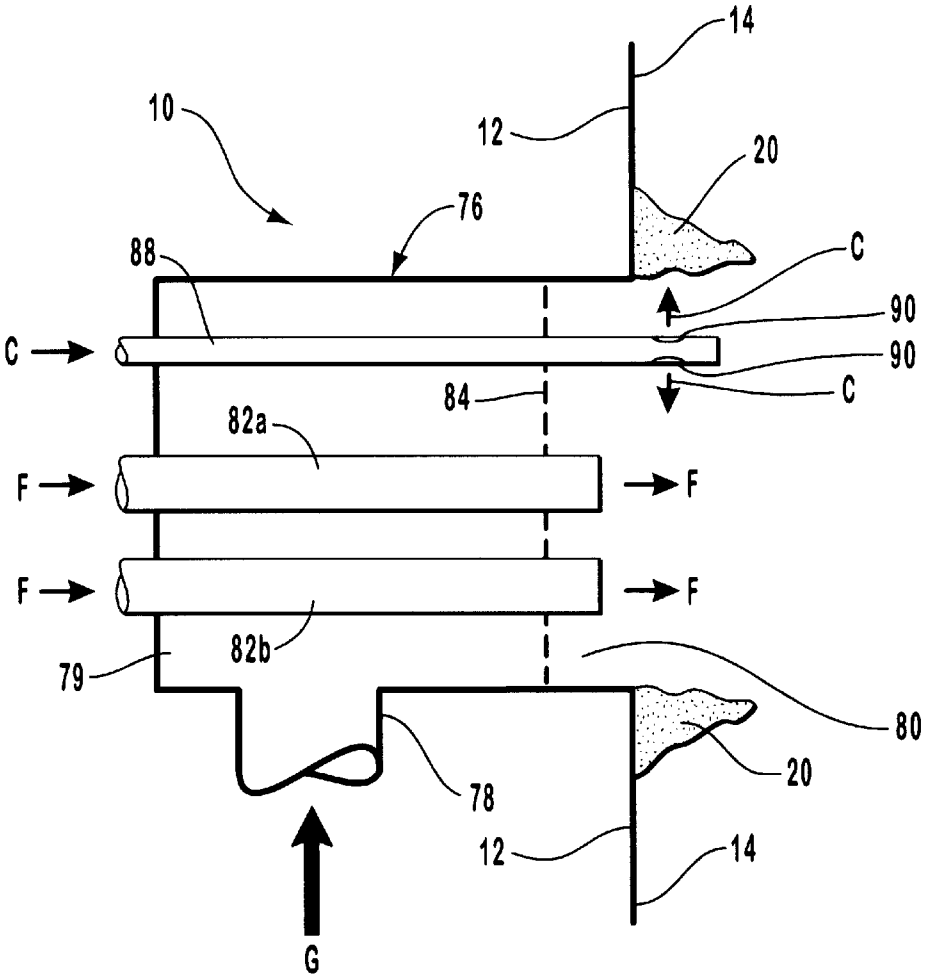

FIGS. 6A and 6B are schematic depictions of a self-cleaning multiple injection port according to a further embodiment of the invention. As discussed in further detail below, an ash removal device such as a blowing member or lance for injecting a blowing medium is located within a passageway of the multiple injection port. The multiple injection port can be formed in a tubewall furnace or a refractory lined furnace. For example, a single tubewall opening can accommodate several reburn fuel injectors and a flame scanner used in the multiple injection port. Cooling air flows around these devices via a perforated plate or other flow controlling device. The lance is inserted through the tubewall opening, fitting alongside the fuel injectors.

As shown in FIG. 6A, furnace wall 12 has a multiple injection port 76 which communicates with the interior of furnace 10. The multiple injection port 76 has an air injecting pipe 78 that opens into an air passageway 79 which is in communication with the interior of furnace 10 through a port opening 80. One or more injectors such as a pair of fuel injectors 82*a* and 82*b* are positioned within passageway 79 of multiple injection port 76. Air for cooling or combustion indicated by arrow G is passed around injectors 82*a* and 82*b* from air injecting pipe 78. An optional flow restriction means for distributing the air flow can be employed in multiple injection port 76, such as a perforated plate 84 having a plurality of apertures 85, or other conventional flow restriction devices may be used.

A fuel material indicated by arrows F such as a reburn fuel is injected by injectors 82*a* and 82*b* through port opening 80 into the inside of furnace 10. Injected air indicated by arrow G passes through air passageway 79 and port opening 80 into the inside of furnace 10. The injected fuel and air interact with furnace gases and suspended ash to produce an ash deposit 20 on interior surface 14 surrounding port opening 80 as shown in FIGS. 6A and 6B.

A blowing lance 88 for discharging a blowing medium is located within passageway 79 of multiple injection port 76. The blowing lance 88 is configured to be moved longitudinally back and forth along the direction of the port axis perpendicular to furnace wall 12. Under normal operation after a cleaning cycle, blowing lance 88 is retracted out of passageway 79 so as not to interfere with the flow of air. When ash deposit removal is desired, blowing lance 88 is extended a preselected distance beyond port opening 80 into the interior of furnace 10, such as shown in FIG. 6A, and the blowing medium is directed outwardly through one or more lance holes 90 at the distal tip of blowing lance 88.

It should be understood that FIGS. 6A and 6B show only one potential location for the blowing lance, and that the blowing lance can be located anywhere in the multiple injection port with a passageway. For example, the blowing lance can be positioned at other locations in passageway 79 or can be inserted through one of the injectors 82*a* or 82*b*. In addition, the blowing lance can be placed in a straight parallel position or at an angle within a passageway in the multiple injection port. Further, more than one blowing lance can be used if desired for a specific application.

During a cleaning cycle, a blowing medium indicated by arrows C is introduced into a proximal end of lance 88 and the blowing medium is injected out into the interior of furnace 10 through lance holes 90. The force produced by the impact of the blowing medium on ash deposit 20 dislodges ash deposit 20 from interior surface 14 and blows deposit 20 away from port opening 80. The lance 88 may be axially rotated during the cleaning operation to effect complete cleaning around the perimeter of port opening 80. At the end of the cleaning cycle, the flow of the blowing medium is stopped and lance 88 is retracted back out of passageway 79.

It should be understood that the various embodiments described herein can be modified to incorporate selected features described herein and be within the intended scope of the invention. For example, the single port/multiple passageway embodiments described above and shown in FIGS. 5A and 6A can be configured to employ annular blowing members with annular passageways for the blowing medium such as shown in FIGS. 3A and 4A.

The invention has the advantage of being a self-cleaning port which avoids the ash deposition problems of conventional ports. The invention integrates a wall blower or blowing lance into a port itself as distinct from the conventional approach of installing a wall blower adjacent to a port. The blowing medium is directed outwardly from the port in order to blow the ash deposits away from rather than across the port opening as in prior approaches. The distance between the wall blower and the port edge in the device of the invention is minimized, thereby providing effective ash deposit removal.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A system for removing ash deposits in a combustion furnace the system comprising:

an outer port sleeve communicatively connected to a combustion furnace and having a port opening through a furnace wall;

an inner port pipe extending through the outer port sleeve and including an interior passageway for transporting an injected material to an interior portion of the combustion furnace; and a retractable annular blowing lance configured around the inner port pipe such that a blowing medium is transported in an annular passageway defined by an outer wall surface of the inner port pipe and an inner wall surface of the blowing lance, the blowing lance movable in a direction substantially parallel to the direction of flow of the injected material, the blowing lance configured to discharge the blowing medium outwardly away from the port opening at an angle toward or parallel to an interior surface of the furnace wall so as to remove ash deposits in the combustion furnace adjacent to the port opening, the blowing lance capable of being retracted after a cleaning cycle so as to be flush with the furnace wall when not in use.

2. The system of claim 1, wherein the blowing lance includes one or more lance holes at a distal end thereof for directing the blowing medium outwardly away from the port opening.

3. The system of claim 1, wherein the blowing lance is capable of extending into the interior of the combustion device a preselected distance in order to facilitate removal of ash deposits around the port opening.

4. The system of claim 1, wherein the blowing lance is capable of axially rotating during discharge of the blowing medium in order to facilitate removal of ash deposits around the port opening.

5. The system of claim 1, wherein the inner port pipe is part of a port structure in a furnace selected from the group consisting of burners for injecting fuel and air, overfire air ports for injecting air, flue gas recirculation ports for injecting a flue gas, reburning ports for injecting a reburning fuel, pollutant emission control injection ports, and sorbent injection ports.

6. The system of claim 1, wherein the injected material is selected from the group consisting of fuel mixed with air, overfire air, flue gas, reburning fuel, agents for $NO_x$ reduction, agents for $SO_2$ reduction, a sorbent material, and mixtures thereof.

7. The system of claim 1, wherein the blowing medium is selected from the group consisting of steam, and air.

8. A system for removing ash deposits in a combustion device, the system comprising:

an inner port pipe in communication with an interior portion of a combustion device, the inner port pipe having an interior passageway for transporting an injected material to the interior portion of the combustion device;

an annular blowing member configured around the inner port pipe and attached to an interior wall of the combustion device while being in communication with an interior portion of the combustion device such that a blowing/cooling medium is transported in an annular passageway defined by an outer wall surface of the port pipe and an inner wall surface of the blowing member so as to remove ash deposits in the combustion device; and an inner sleeve slidably engaged with an outside surface of the inner port pipe, the sleeve including a lip portion at a distal end thereof and configured to direct the flow of the blowing/cooling medium impacting upon the ash deposits, the lip portion being adapted to allow passage of a quantity of the blowing/cooling medium into the combustion device upon being retracted into the annular passageway.

9. The system of claim 8, wherein the blowing member works in conjunction with the lip portion on the sleeve such that the blowing/cooling medium is directed outwardly toward ash deposits in the combustion device.

10. The system of claim 8, wherein the sleeve and lip portion are capable of extending into the interior of the combustion device a preselected distance.

11. The system of claim 8, wherein the inner port pipe is part of a port structure in a furnace selected from the group consisting of burners for injecting fuel and air, overfire air ports for injecting air, flue gas recirculation ports for injecting a flue gas, reburning ports for injecting a reburning fuel, pollutant emission control injection ports, and sorbent injection ports.

12. The system of claim 8, wherein the injected material is selected from the group consisting of fuel mixed with air, overfire air, flue gas, reburning fuel, agents for $NO_x$ reduction, agents for $SO_2$ reduction, a sorbent material, and mixtures thereof.

13. A self-cleaning burner port for a combustion furnace, comprising:

an air injecting pipe with an air passageway communicatively connected to a port opening in the combustion furnace;

a fuel injecting pipe with a fuel passageway disposed in the air passageway and in communication with the port opening;

a first retractable blowing lance disposed in the air passageway and configured to discharge a blowing medium outwardly away from the port opening so as to remove ash deposits in the combustion furnace adjacent to the port opening; and a second retractable blowing lance disposed in the fuel passageway and configured to discharge a blowing medium outwardly away from the port opening so as to remove ash deposits in the combustion furnace adjacent to the port opening;

wherein when ash removal is desired, the first and second blowing lances are extended a preselected distance beyond the port opening into the interior of the combustion furnace, and when ash removal is completed, the first and second blowing lances are retracted out of the air passageway and the fuel passageway so as to not interfere with the flow of fuel and air.

14. The burner port of claim 13, further comprising air swirl vanes disposed in the air passageway.

15. The burner port of claim 13, wherein the first and second lances are axially rotatable in order to facilitate removal of ash deposits around the port opening.

16. The burner port of claim 13, wherein the combustion furnace is a tubewall furnace or a refractory lined furnace.

* * * * *